US012716600B2

(12) United States Patent
Li et al.

(10) Patent No.: US 12,716,600 B2
(45) Date of Patent: Aug. 25, 2026

(54) ACTIVE CAPTURE DEVICE FOR AFRICAN SWINE FEVER AEROSOL AND DETECTION METHOD THEREFOR

(71) Applicants: Xiajin New hope Liuhe agriculture and animal husbandry Co., LTD, Shandong (CN); Shandong New hope Liuhe Agriculture and Animal Husbandry Technology Co. LTD, Shandong (CN); Qingdao Xinmu Zhikang Biotechnology Co., LTD, Shandong (CN); Shandong new hope Liuhe Group Co., Ltd, Shandong (CN); New Hope Liuhe Co., Ltd, Sichuan (CN); Juye Xinhao Agriculture and Animal Husbandry Co. LTD, Shandong (CN)

(72) Inventors: Xiaowen Li, Shandong (CN); Lujie Bian, Shandong (CN); Zhiqiang Hu, Shandong (CN); Qingyuan Liu, Shandong (CN); Mingyu Fan, Shandong (CN); Weisheng Wu, Shandong (CN); Xiaogang Tian, Shandong (CN); Lili Wu, Shandong (CN); Zheng Yan, Shandong (CN); Yongquan Wang, Shandong (CN)

(73) Assignees: Xiajin New hope Liuhe agriculture and animal husbandry Co., LTD, Shandong (CN); Shandong New hope Liuhe Agriculture and Animal Husbandry Technology Co. LTD, Shandong (CN); Qingdao Xinmu Zhikang Biotechnology Co., LTD, Shandong (CN); Shandong new hope Liuhe Group Co., Ltd, Shandong (CN); New Hope Liuhe Co., Ltd, Sichuan (CN); Juye Xinhao Agriculture and Animal Husbandry Co. LTD, Shandong (CN)

( * ) Notice: Subject to any disclaimer, the term of this patent is extended or adjusted under 35 U.S.C. 154(b) by 310 days.

(21) Appl. No.: 18/629,948

(22) Filed: Apr. 9, 2024

(65) Prior Publication Data

US 2024/0384884 A1 Nov. 21, 2024

(30) Foreign Application Priority Data

May 19, 2023 (CN) ..... 202310579641.6

(51) Int. Cl.
*F24F 11/30* (2018.01)
*F24F 110/64* (2018.01)

(52) U.S. Cl.
CPC ..... *F24F 11/30* (2018.01); *F24F 2110/64* (2018.01)

(58) Field of Classification Search
CPC ..... F24F 11/30; F24F 2110/64
See application file for complete search history.

(56) References Cited

U.S. PATENT DOCUMENTS 12,584,841 B2 * 3/2026 Pal ..... F24F 8/22
2021/0239635 A1 * 8/2021 Prasad ..... G01N 33/5438
(Continued)

*Primary Examiner* — Ramsey Refai
(74) *Attorney, Agent, or Firm* — JCIPRNET

(57) ABSTRACT

The present invention provides an active capture device for African Swine fever aerosol and a detection method therefor. The device includes a hollow casing, and an aerosol capture mechanism and an internal circulating filtering mechanism which are disposed inside the casing; the casing includes a
(Continued)

top plate and a bottom plate, and an annular side plate is disposed between edge positions of the top plate and the bottom plate; the aerosol capture mechanism includes a ventilation duct disposed at the front end of the annular side plate; one end of the ventilation duct is disposed inside the hollow casing and the other end of the ventilation duct penetrates through the annular side plate and is disposed outside the hollow casing; a fan is disposed inside the casing; the fan is communicated with the ventilation duct; and an adsorption pipe network is disposed inside the ventilation duct.

9 Claims, 3 Drawing Sheets

(56) References Cited

U.S. PATENT DOCUMENTS

| | | | | |
|---|---|---|---|---|
| 2021/0386317 | A1* | 12/2021 | Prasad | G01N 27/4162 |
| 2022/0018797 | A1* | 1/2022 | Botte | G01N 15/0656 |
| 2023/0152199 | A1* | 5/2023 | Pal | F24F 8/22<br>205/777.5 |
| 2023/0279509 | A1* | 9/2023 | Esposito | G01N 1/24<br>435/5 |
| 2023/0296482 | A1* | 9/2023 | Moriarty | G01N 1/2273<br>422/509 |
| 2023/0408121 | A1* | 12/2023 | Pal | G01N 33/497 |
| 2024/0148274 | A1* | 5/2024 | Chen | A61B 10/00 |
| 2024/0272060 | A1* | 8/2024 | Ye | G01N 21/51 |

* cited by examiner

ACTIVE CAPTURE DEVICE FOR AFRICAN SWINE FEVER AEROSOL AND DETECTION METHOD THEREFOR

CROSS-REFERENCE TO RELATED APPLICATION

This application claims the priority benefit of China application no. 202310579641.6, filed on May 19, 2023. The entirety of the above-mentioned patent application is hereby incorporated by reference herein and made a part of this specification.

BACKGROUND OF THE INVENTION

1. Technical Field

The present invention relates to the field of detection of African Swine fever, and in particular to an active capture device for African Swine fever aerosol and a detection method therefor.

2. Background Art

African Swine fever (ASF) has occurred, spread and been prevalent across many countries around the world. China is a big country for raising pigs and also has huge pork consumption, with the number of slaughtered pigs, breeding stock of pigs and pork consumption ranking first in the world. The total import volume of breeding pigs and pork products is huge every year, and the trade with many countries is frequent. As a result, the direct and indirect losses caused by ASF will be immeasurable.

ASF is an acute, febrile and highly contacting infectious disease caused by African Swine fever virus (ASFV), with the incidence and fatality up to 100%. ASFV belongs to the Asfarviridae family and Asfivirus and is the only member in the Asfarviridae family, without any closely related virus. The first ASF outbreak in China was in 2018. As the total number of live pigs in China accounted for more than half of the world, the outbreak of ASFV caused massive deaths within a short time. Until now, a lot of research evidence has shown that ASFV can spread through aerosol in the air and cause infection in pigs. However, so far, there has been no effective and portable sampling device for ASF aerosol in the air of pigsties, which affects the ability to assess the risk of spreading ASF through aerosol in the pigsties and is not conducive to the prevention and control of the spreading of ASF through the aerosol.

SUMMARY OF THE INVENTION

The present invention is intended to provide an active capture device for African Swine fever aerosol and a detection method therefor, which are simple in structure and convenient to use, and can capture African swine fever aerosol on one hand and quickly detect viruses at the same time.

The present invention is achieved by the following measures:

an active capture device for African Swine fever aerosol and a detection method therefor, the active capture device including a hollow casing, and an aerosol capture mechanism and an internal circulating filtering mechanism which are disposed inside the casing;

the casing includes a top plate and a bottom plate, and an annular side plate is disposed between edge positions of the top plate and the bottom plate;

the aerosol capture mechanism includes a ventilation duct disposed at the front end of the annular side plate; one end of the ventilation duct is disposed inside the hollow casing and the other end of the ventilation duct penetrates through the annular side plate and is disposed outside the hollow casing; a fan is disposed inside the casing; the fan is communicated with the ventilation duct;

an adsorption pipe network is disposed inside the ventilation duct;

the internal circulating filtering mechanism includes a circulating water pump disposed inside the casing and on the bottom plate; a water inlet pipe is disposed at a water inlet end of the circulating water pump; a free end of the water inlet pipe penetrates through the ventilation duct to be communicated with one side of the adsorption pipe network; a liquid outlet pipe is disposed at a water outlet end of the circulating water pump; the free end of the liquid outlet pipe penetrates through the ventilation duct to be communicated with the other side of the adsorption pipe network;

the adsorption pipe network communicates the liquid inlet pipe with the liquid outlet pipe to form a circulating pipe body;

a 200 nm filtration membrane is disposed on the liquid inlet pipe; an ultrafiltration membrane is disposed on the liquid outlet pipe; a plurality of penetrating through holes are correspondingly formed in two sides of pipe bodies of the adsorption pipe network; and semipermeable membranes are disposed at the inner sides of the pipe bodies of the adsorption pipe network.

The present invention also has the following specific characteristics:

a liquid injection pipe is disposed at one side, close to the ventilation duct, of the liquid inlet pipe, and an end of the liquid injection pipe penetrates through the annular side plate and is disposed outside the casing; and a liquid discharge pipe is disposed at one side, close to the circulating water pump, of the liquid outlet pipe, and the end of the liquid discharge pipe penetrates through the annular side plate and is disposed outside the casing.

Preferably, positive and negative electrode pieces are disposed on inner walls of upper and lower sides of the ventilation duct, respectively; a storage battery is disposed inside the casing; the positive and negative electrode pieces are connected to the storage battery;

the fan and the circulating water pump are connected to the storage battery, and are provided with separate control switches for controlling the positive and negative electrode pieces, the fan, and the circulating water pump;

during the capture of aerosol, the switches for the positive and negative electrode pieces and the fan can be turned on, air enters the ventilation duct due to the suction of the fan, and the negative electrode piece is excited to generate electrons in the case of being conductive; and the electrons give the aerosol a negative charge, and the aerosol is adsorbed on the positive electrode piece; after the collection, the front end of the ventilation duct can be sealed, and positive and negative electrodes can be kept continuously energized; then, the aerosol is captured and collected at different positions; after the collection, the switches for the positive and negative electrode pieces are turned off and the fan is turned on; and then, the aerosol on the positive electrode piece is adsorbed on the semipermeable membranes through the suction of the fan for detection in the next step.

the adsorption pipe network includes vertical pipes disposed at left and right sides in the ventilation duct; a plurality of branch horizontal pipes are disposed between the vertical pipes at two sides; a plurality of penetrating through holes are correspondingly formed in two sides of the plurality of branch horizontal pipes; and the semipermeable membranes are disposed at the inner sides of pipe bodies of the plurality of branch horizontal pipes.

A rectangular insertion barrel is disposed at one side, far away from the circulating water pump, of the 200 nm filtration membrane and on the liquid inlet pipe; one end of the rectangular insertion barrel is communicated with the inner side of the water inlet pipe; and the other end of the rectangular insertion barrel penetrates through the annular side plate and is disposed outside the casing.

Sealing caps are disposed at the ends of the liquid injection pipe, the liquid discharge pipe, and the rectangular insertion barrel.

U-shaped slots with open tops are formed in the liquid inlet pipe and the liquid outlet pipe, and the U-shaped slots at two sides are communicated with the liquid inlet pipe and the liquid outlet pipe, respectively;

a pair of U-shaped insertion plates are disposed inside the U-shaped slots; a pair of corresponding through holes are formed in the pair of U-shaped inserting plates; the 200 nm filtration membrane is disposed between the pair of U-shaped insertion plates on the liquid inlet pipe; the ultrafiltration membrane is disposed between the pair of U-shaped insertion plates on the liquid outlet pipe;

during the replacement of the 200 nm filtration membrane and the ultrafiltration membrane, the U-shaped insertion plates can be pulled out and the filtration membrane is cut to a certain size; then, the cut filtration membrane is clamped between the pair of U-shaped insertion plates, and the pair of U-shaped insertion plates are inserted into the corresponding U-shaped slots;

a plurality of insertion posts are disposed at the top of the U-shaped insertion plate at one side, and a plurality of corresponding sockets are formed in the U-shaped insertion plate at the other side; the insertion posts are disposed in the sockets, thereby forming transverse limit to the U-shaped insertion plates;

during the washing of the capture device, the 200 nm filtration membrane and the ultrafiltration membrane can be taken off first, and the U-shaped insertion plates are inserted and reset; then, the liquid injection pipe and the liquid discharge pipe are opened, and liquid in the circulating pipe body flows out from the liquid discharge pipe; then, the liquid discharge pipe is closed, clean washing liquid is injected by the liquid injection pipe, and the circulating water pump is turned on to perform circulating flushing; and finally, the washing liquid is emptied.

A protective cover body is disposed at the end of the ventilation duct; a plurality of filter holes are formed in the protective cover body; and the protective cover body can prevent large-particle impurities from being sucked into the ventilation duct; and the ventilation duct is in threaded connection with the protective cover body.

A sealing ring is disposed at a top edge of each U-shaped insertion plate, and a groove is formed in a top side face of the U-shaped insertion plate; and the leakproofness of the U-shaped slots is ensured by disposing the sealing rings.

The detection method includes the following steps:

S1: firstly, turning on the fan to enable air to flow along the ventilation duct to the adsorption pipe network, with part of matters in the air such as aerosol, dust and the like being adsorbed on the semipermeable membranes, where preferably, the semipermeable membranes are 0.25 nm filtration membranes;

S2: turning off the fan, opening the liquid injection pipe to inject filtered liquid into the circulating pipe body, and then, closing the liquid injection pipe and turning on the circulating water pump, where the circulating water pump drives the liquid in the circulating pipe body to flow; when the liquid flows through the adsorption pipe network, utilizing the semipermeable membranes to isolate, with viruses in the aerosol and part of dust entering the circulating pipe body; then, filtering through the 200 nm filtration membrane on the liquid inlet pipe and the ultrafiltration membrane on the liquid outlet pipe in a circulating manner, where during the circulation, the 200 nm filtration membrane on the liquid inlet pipe can isolate the viruses in the liquid at the front side of the 200 nm filtration membrane (below the rectangular insertion barrel), and the ultrafiltration membrane on the liquid outlet pipe can filter tiny pathogens, thereby ensuring the accuracy of later detection;

S3: after the filtration is completed, turning off the circulating water pump, opening the rectangular insertion barrel vertically upwards, and putting test paper through the rectangular insertion barrel and inserting same into the circulating pipe body for detection; and S4: reading a detection result.

The present invention has the beneficial effects: simple structure, convenience for use, and capabilities of capturing the African swine fever aerosol on one hand and quickly detecting the viruses at the same time.

Figure 1:
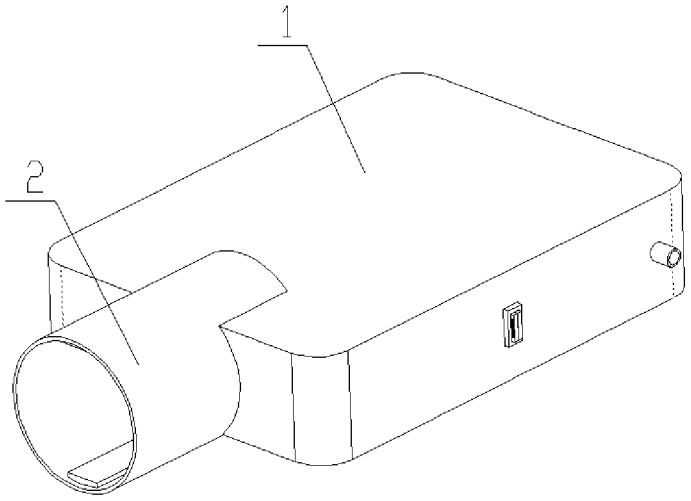
FIG. 1 is a schematic structural diagram of an embodiment of the present invention.

Where, reference numerals are: 1. casing; 2. ventilation duct; 3. fan; 4. adsorption pipe network; 401. vertical pipe; 402. branch horizontal pipe; 403. through hole; 404. semipermeable membrane; 5. circulating water pump; 6. water inlet pipe; 7. liquid injection pipe; 8. liquid outlet pipe; 9. liquid discharge pipe; 10. U-shaped slot; 11. U-shaped insertion plate; 1101. through hole; 12. rectangular insertion barrel; 13. positive electrode piece; 14. negative electrode piece; 15. ultrafiltration membrane; 16. groove; 17. insertion post; 18. socket.

DETAILED DESCRIPTION OF THE EMBODIMENTS

To clearly explain the technical characteristics of the present solution, the present solution will be described below in conjunction with a specific embodiment.

Figure 2:
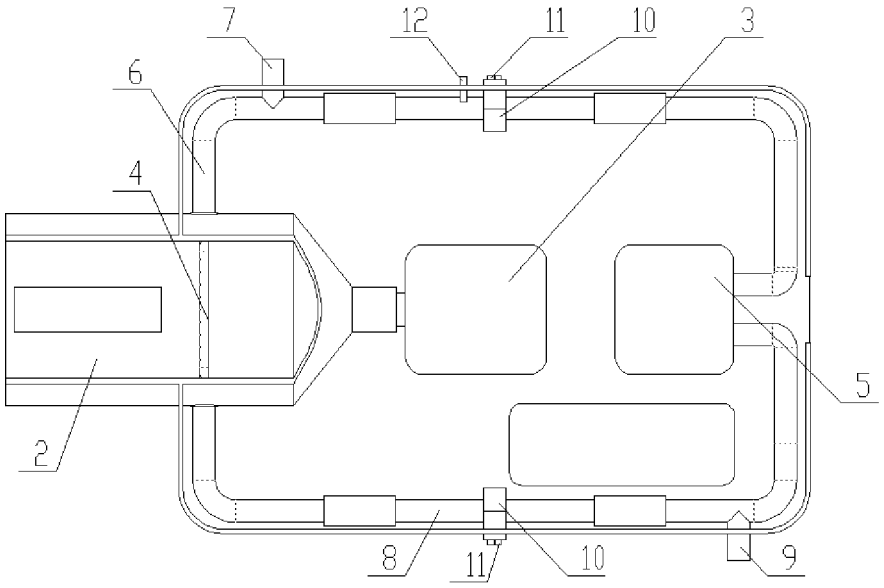
FIG. 2 is a schematic diagram of an inner structure of an embodiment of the present invention.
Figure 3:
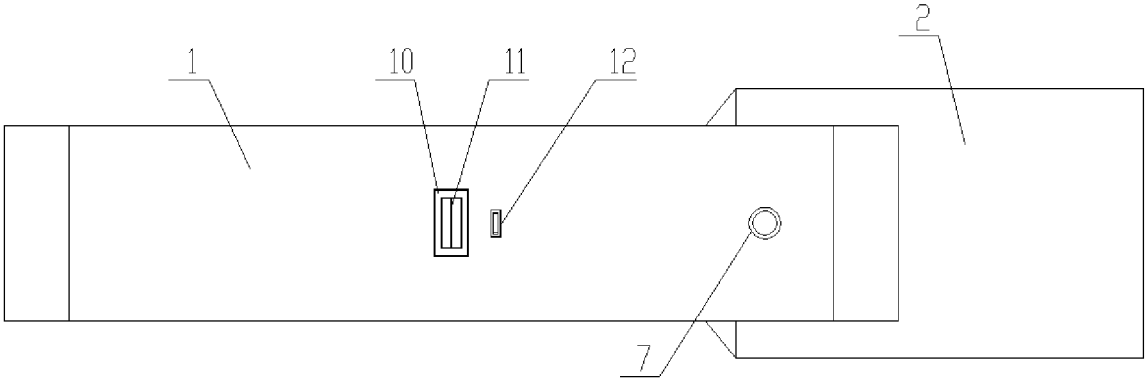
FIG. 3 is a schematic structural diagram of an embodiment of the present invention.
Figure 4:
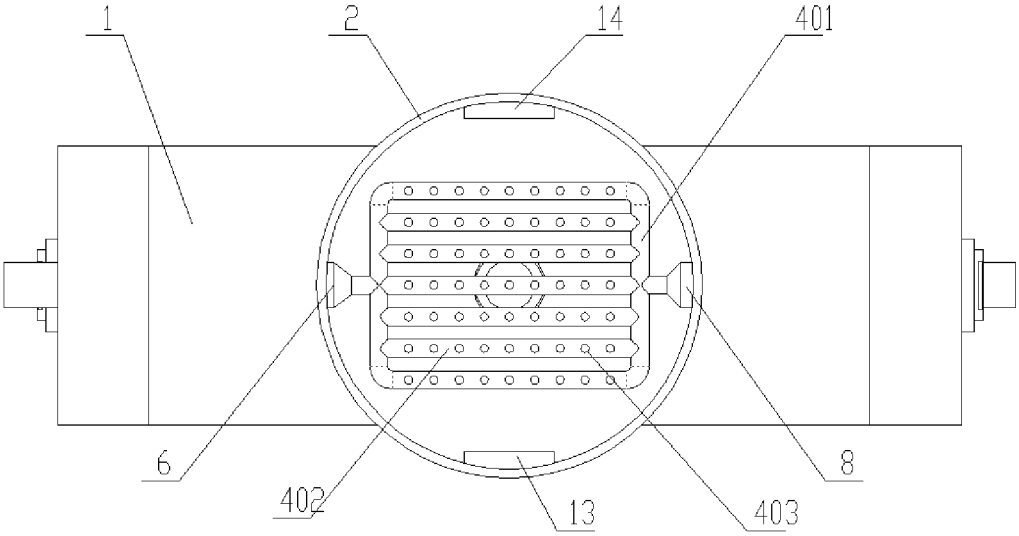
FIG. 4 is a schematic structural diagram of an embodiment of the present invention.
Figure 5:
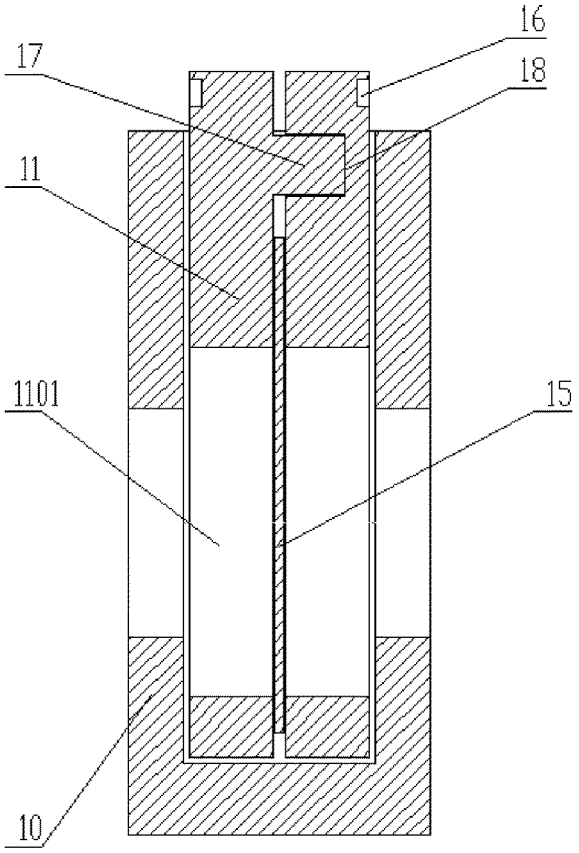
FIG. 5 is a schematic diagram of an inner structure of a branch horizontal pipe of an embodiment of the present invention.
Figure 6:
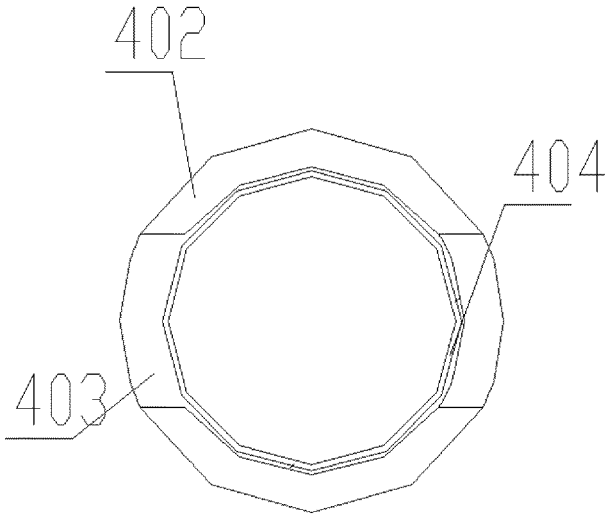
FIG. 6 is a schematic diagram of an inner structure of a U-shaped slot of an embodiment of the present invention.

Referring to FIG. 1 to FIG. 6, an active capture device for African Swine fever aerosol includes a hollow casing 1, and an aerosol capture mechanism and an internal circulating filtering mechanism which are disposed inside the casing 1;

the casing 1 includes a top plate and a bottom plate, and an annular side plate is disposed between edge positions of the top plate and the bottom plate;

the aerosol capture mechanism includes a ventilation duct 2 disposed at the front end of the annular side plate; one end of the ventilation duct 2 is disposed inside the hollow casing 1 and the other end of the ventilation duct 2 penetrates through the annular side plate and is disposed outside the hollow casing 1; a fan 3 is disposed inside the casing 1; the fan 3 is communicated with the ventilation duct 2;

an adsorption pipe network 4 is disposed inside the ventilation duct 2;

the internal circulating filtering mechanism includes a circulating water pump 5 disposed inside the casing 1 and on the bottom plate; a water inlet pipe 6 is disposed at a water inlet end of the circulating water pump 5; a free end of the water inlet pipe 6 penetrates through the ventilation duct 2 to be communicated with one side of the adsorption pipe network 4; a liquid outlet pipe 8 is disposed at a water outlet end of the circulating water pump 5; the free end of the liquid outlet pipe 8 penetrates through the ventilation duct 2 to be communicated with the other side of the adsorption pipe network 4;

the adsorption pipe network 4 communicates the liquid inlet pipe 6 with the liquid outlet pipe 8 to form a circulating pipe body;

a 200 nm filtration membrane is disposed on the liquid inlet pipe 6; an ultrafiltration membrane 15 is disposed on the liquid outlet pipe 8; a plurality of penetrating through holes 1101 are correspondingly formed in two sides of pipes bodies of the adsorption pipe network 4; and semipermeable membranes 404 are disposed at the inner sides of the pipe bodies of the adsorption pipe network 4;

a liquid injection pipe 7 is disposed at one side, close to the ventilation duct 2, of the liquid inlet pipe 6, and an end of the liquid injection pipe 7 penetrates through the annular side plate and is disposed outside the casing 1; and a liquid discharge pipe 9 is disposed at one side, close to the circulating water pump 5, of the liquid outlet pipe 8, and the end of the liquid discharge pipe 9 penetrates through the annular side plate and is disposed outside the casing 1.

Preferably, positive and negative electrode pieces are disposed on inner walls of upper and lower sides of the ventilation duct 2, respectively; a storage battery is disposed inside the casing 1; the positive and negative electrode pieces are connected to the storage battery;

the fan 3 and the circulating water pump 5 are connected to the storage battery, and are provided with separate control switches for controlling the positive and negative electrode pieces, the fan 3, and the circulating water pump 5;

during the capture of aerosol, the switches for the positive and negative electrode pieces and the fan 3 can be turned on, air enters the ventilation duct 2 due to the suction of the fan 3, and the negative electrode piece 14 is excited to generate electrons in the case of being conductive; and the electrons give the aerosol a negative charge, and the aerosol is adsorbed on the positive electrode piece 13; after the collection, the front end of the ventilation duct 2 can be sealed, and positive and negative electrodes can be kept continuously energized; then, the aerosol is captured and collected at different positions; after the collection, the switches for the positive and negative electrode pieces are turned off and the fan 3 is turned on; and then, the aerosol on the positive electrode piece 13 is adsorbed on the semipermeable membranes 404 through the suction of the fan 3 for detection in the next step;

the adsorption pipe network 4 includes vertical pipes 401 disposed at left and right sides in the ventilation duct 2; a plurality of branch horizontal pipes 402 are disposed between the vertical pipes 401 at two sides; a plurality of penetrating through holes 403 are correspondingly formed in two sides of the plurality of branch horizontal pipes 402; and the semipermeable membranes 404 are disposed at the inner sides of pipe bodies of the plurality of branch horizontal pipes 402.

A rectangular insertion barrel 12 is disposed at one side, far away from the circulating water pump 5, of the 200 nm filtration membrane and on the liquid inlet pipe 6; one end of the rectangular insertion barrel 12 is communicated with the inner side of the water inlet pipe 6; and the other end of the rectangular insertion barrel 12 penetrates through the annular side plate and is disposed outside the casing 1.

Sealing caps are disposed at the ends of the liquid injection pipe 7, the liquid discharge pipe 9, and the rectangular insertion barrel 12.

U-shaped slots 10 with open tops are formed in the liquid inlet pipe 6 and the liquid outlet pipe 8, and the U-shaped slots 10 at two sides are communicated with the liquid inlet pipe 6 and the liquid outlet pipe 8, respectively;

a pair of U-shaped insertion plates 11 are disposed inside the U-shaped slots 10; a pair of corresponding through holes 1101 are formed in the pair of U-shaped inserting plates 11; the 200 nm filtration membrane is disposed between the pair of U-shaped insertion plates 11 on the liquid inlet pipe 6; the ultrafiltration membrane 15 is disposed between the pair of U-shaped insertion plates 11 on the liquid outlet pipe 8;

during the replacement of the 200 nm filtration membrane and the ultrafiltration membrane 15, the U-shaped insertion plates 11 can be pulled out and the filtration membrane is cut to a certain size; then, the cut filtration membrane is clamped between the pair of U-shaped insertion plates 11, and the pair of U-shaped insertion plates 11 are inserted into the corresponding U-shaped slots 10;

a plurality of insertion posts 17 are disposed at the top of the U-shaped insertion plate 11 at one side, and a plurality of corresponding sockets 18 are formed in the U-shaped insertion plate 11 at the other side; the insertion posts 17 are disposed in the sockets 18, thereby forming transverse limit to the U-shaped insertion plates 11;

during the washing of the capture device, the 200 nm filtration membrane and the ultrafiltration membrane 15 can be taken off first, and the U-shaped insertion plates 11 are inserted and reset; then, the liquid injection pipe 7 and the liquid discharge pipe 9 are opened, and liquid in the circulating pipe body flows out from the liquid discharge pipe 9; then, the liquid discharge pipe 9 is closed, clean washing liquid is injected by the liquid injection pipe 7, and the circulating water pump 5 is turned on to perform circulating flushing; and finally, the washing liquid is emptied.

A protective cover body is disposed at the end of the ventilation duct 2; a plurality of filter holes are formed in the protective cover body; and the protective cover body can prevent large-particle impurities from being sucked into the ventilation duct 2; and the ventilation duct 2 is in threaded connection with the protective cover body.

A sealing ring is disposed at a top edge of each U-shaped insertion plate 11, and a groove 16 is formed in a top side face of the U-shaped insertion plate 11; and the leakproofness of the U-shaped slots 10 is ensured by disposing the sealing rings.

The detection method includes the following steps:

S1: firstly, turning on the fan 3 to enable air to flow along the ventilation duct 2 to the adsorption pipe network 4, with part of matters in the air such as aerosol, dust and the like being adsorbed on the semipermeable membranes 404, where preferably, the semipermeable membranes 404 are 0.25 nm filtration membranes;

S2: turning off the fan 3, opening the liquid injection pipe 7 to inject filtered liquid into the circulating pipe body, and then, closing the liquid injection pipe 7 and turning on the circulating water pump 5, where the circulating water pump 5 drives the liquid in the circulating pipe body to flow; when the liquid flows through the adsorption pipe network 4, utilizing the semipermeable membranes 404 to isolate, with viruses in the aerosol and part of dust entering the circulating pipe body; then, filtering through the 200 nm filtration membrane on the liquid inlet pipe 6 and the ultrafiltration membrane 15 on the liquid outlet pipe 8 in a circulating manner, where during the circulation, the 200 nm filtration membrane on the liquid inlet pipe 6 can isolate the viruses in the liquid at the front side of the 200 nm filtration membrane (below the rectangular insertion barrel 12), and the ultrafiltration membrane 15 on the liquid outlet pipe 8 can filter tiny pathogens, thereby ensuring the accuracy of later detection;

S3: after the filtration is completed, turning off the circulating water pump 5, opening the rectangular insertion barrel 12 vertically upwards, and putting test paper through the rectangular insertion barrel 12 and inserting same into the circulating pipe body for detection; and S4: reading a detection result.

The technical features not described of the present invention can be implemented through or by using the prior art, which is not described herein. It should be noted that the above description is not intended to limit the present invention, and the present invention is not limited to the above examples. Changes, modifications, additions or replacements made by those of ordinary skill in the art within the essential range of the present invention should fall within the protection scope of the present invention.

What is claimed is:

1. An active capture device for African Swine fever aerosol, comprising a hollow casing, and an aerosol capture mechanism and an internal circulating filtering mechanism which are disposed inside the hollow casing, wherein the hollow casing comprises a top plate and a bottom plate, and an annular side plate disposed between edge positions of the top plate and the bottom plate;

the aerosol capture mechanism comprises a ventilation duct disposed at the front end of the annular side plate; one end of the ventilation duct is disposed inside the hollow casing and the other end of the ventilation duct penetrates through the annular side plate and is disposed outside the hollow casing; a fan is disposed inside the hollow casing; the fan is communicated with the ventilation duct;

an adsorption pipe network is disposed inside the ventilation duct;

the internal circulating filtering mechanism comprises a circulating water pump disposed inside the hollow casing and on the bottom plate; a water inlet pipe is disposed at a water inlet end of the circulating water pump; a free end of the water inlet pipe penetrates through the ventilation duct to be communicated with one side of the adsorption pipe network; a liquid outlet pipe is disposed at a water outlet end of the circulating water pump; the free end of the liquid outlet pipe penetrates through the ventilation duct to be communicated with the other side of the adsorption pipe network;

the adsorption pipe network communicates the liquid inlet pipe with the liquid outlet pipe to form a circulating pipe body;

a 200 nm filtration membrane is disposed on the liquid inlet pipe; an ultrafiltration membrane is disposed on the liquid outlet pipe; a plurality of penetrating through holes are correspondingly formed in two sides of pipe bodies of the adsorption pipe network; and semipermeable membranes are disposed at the inner sides of the pipe bodies of the adsorption pipe network.

2. The active capture device for African Swine fever aerosol according to claim 1, wherein a liquid injection pipe is disposed at one side, close to the ventilation duct, of the liquid inlet pipe, and an end of the liquid injection pipe penetrates through the annular side plate and is disposed outside the hollow casing; and a liquid discharge pipe is disposed at one side, close to the circulating water pump, of the liquid outlet pipe, and the end of the liquid discharge pipe penetrates through the annular side plate and is disposed outside the hollow casing.

3. The active capture device for African Swine fever aerosol according to claim 2, wherein the adsorption pipe network comprises vertical pipes disposed at left and right sides in the ventilation duct; a plurality of branch horizontal pipes is disposed between the vertical pipes at two sides; a plurality of penetrating through holes are correspondingly formed in two sides of the plurality of branch horizontal pipes; and the semipermeable membranes are disposed at the inner sides of pipe bodies of the plurality of branch horizontal pipes.

4. The active capture device for African Swine fever aerosol according to claim 3, wherein a rectangular insertion barrel is disposed at one side, far away from the circulating water pump, of the 200 nm filtration membrane and on the liquid inlet pipe; one end of the rectangular insertion barrel is communicated with the inner side of the water inlet pipe; and the other end of the rectangular insertion barrel penetrates through the annular side plate and is disposed outside the hollow casing.

5. The active capture device for African Swine fever aerosol according to claim 4, wherein sealing caps are disposed at the ends of the liquid injection pipe, the liquid discharge pipe, and the rectangular insertion barrel.

6. The active capture device for African Swine fever aerosol according to claim 5, wherein U-shaped slots with open tops are formed in the liquid inlet pipe and the liquid outlet pipe, and the U-shaped slots at two sides are communicated with the liquid inlet pipe and the liquid outlet pipe, respectively;

a pair of U-shaped insertion plates are disposed inside the U-shaped slots; a pair of corresponding through holes are formed in the pair of U-shaped inserting plates; the 200 nm filtration membrane is disposed between the pair of U-shaped insertion plates on the liquid inlet pipe; and the ultrafiltration membrane is disposed between the pair of U-shaped insertion plates on the liquid outlet pipe.

7. The active capture device for African Swine fever aerosol according to claim 6, wherein a protective cover body is disposed at the end of the ventilation duct, and a plurality of filter holes are formed in the protective cover body.

8. The active capture device for African Swine fever aerosol according to claim 7, wherein a sealing ring is disposed at a top edge of each U-shaped insertion plate, and a groove is formed in a top side face of the U-shaped insertion plate.

9. A detection method of using the active capture device for African Swine fever aerosol according to claim 8, wherein the detection method comprises the following steps:

S1: firstly, turning on the fan to enable air to flow along the ventilation duct to the adsorption pipe network, with part of matters in the air such as aerosol, dust and the like being adsorbed on the semipermeable membranes;

S2: turning off the fan, opening the liquid injection pipe to inject filtered liquid into the circulating pipe body, and then, closing the liquid injection pipe and turning on the circulating water pump, wherein the circulating water pump drives the liquid in the circulating pipe body to flow; when the liquid flows through the adsorption pipe network, utilizing the semipermeable membranes to isolate, with viruses in the aerosol and part of dust entering the circulating pipe body; then, filtering through the 200 nm filtration membrane on the liquid inlet pipe and the ultrafiltration membrane on the liquid outlet pipe in a circulating manner;

S3: after the filtration is completed, turning off the circulating water pump, opening the rectangular insertion barrel vertically upwards, and putting a test paper through the rectangular insertion barrel and inserting the test paper into the circulating pipe body for detection; and S4: reading a detection result.

* * * * *